US005272984A

United States Patent [19]

Bolliger et al.

[11] Patent Number: 5,272,984

[45] Date of Patent: Dec. 28, 1993

[54] AMUSEMENT RIDE OF THE ROLLER COASTER TYPE

[75] Inventors: Walter Bolliger, Antagnes; Claude Mabillard, Choëx, both of Switzerland

[73] Assignee: Bolliger & Mabillard Ingenieurs Conseils S.A., Switzerland

[21] Appl. No.: 975,788

[22] Filed: Nov. 13, 1992

[30] Foreign Application Priority Data

Dec. 2, 1991 [CH] Switzerland ..... 3535/91

[51] Int. Cl.[5] ..... B61B 3/00

[52] U.S. Cl. ..... 104/63; 104/89; 105/149.2

[58] Field of Search ..... 104/53, 55, 56, 57, 104/63, 64, 65, 66, 89, 95, 106, 107, 245, 246; 105/148, 155, 149.1, 149.2; 472/36, 37, 38, 28, 29, 30, 31-

[56] References Cited

U.S. PATENT DOCUMENTS

| | | | |
|---|---|---|---|
| 763,811 | 6/1904 | Thomas | 472/31 |
| 2,135,230 | 11/1938 | Courtney | 104/76 |
| 3,176,983 | 4/1965 | Barber | 472/30 |
| 3,484,104 | 12/1969 | Goforth et al. | 105/149.2 |
| 3,556,015 | 1/1971 | Pender | 105/149.2 |
| 3,941,060 | 3/1976 | Morsbach | 104/63 |

FOREIGN PATENT DOCUMENTS

| | | | |
|---|---|---|---|
| 0696184 | 10/1964 | Canada | 472/36 |
| 0711048 | 6/1965 | Canada | 105/149.2 |
| 0182192 | 3/1907 | Fed. Rep. of Germany | 472/31 |
| 2750136 | 5/1978 | Fed. Rep. of Germany | 105/149.2 |
| 0899468 | 5/1945 | France | 104/55 |
| 0148368 | 6/1991 | Japan | 105/149.2 |
| 91/13662 | 9/1991 | PCT Int'l Appl. | 104/53 |
| 0844427 | 7/1981 | U.S.S.R. | 105/149.2 |
| 2109252 | 6/1983 | United Kingdom | 104/53 |

*Primary Examiner*—Mark T. Le
*Attorney, Agent, or Firm*—Woodard, Emhardt, Naughton Moriarty & McNett

[57] ABSTRACT

The amusement ride comprises at least one seat suspended on a bogie moving along at least one rail. The seat is provided with a harness for the restraint of at least one passenger in the seat. The seat-harness unit is shaped so as to form a restraint imprisoning the passenger's body when the harness is in the closed position, each of the passenger's four limbs emerging from said restraint through a separate opening, so that the passenger is suspended with his legs in mid-air without a wall or a floor around him.

3 Claims, 5 Drawing Sheets

AMUSEMENT RIDE OF THE ROLLER COASTER TYPE

The present invention relates to an amusement ride of the roller coaster type.

Amusement parks are enjoying a constantly increasing success both in the United States, where they were introduced, and also in the rest of the world. These parks offer their clientele a vast range of attractions, the most popular, the most spectacular and the most impressive of which is certainly that known by the name of switchback or roller coaster. Traditionally, roller coasters comprise one or several trucks travelling on the rails of a ride a little in the manner of a train. The passengers appreciate this attraction for the strong impressions which it produces. These impressions may be objective insofar as the various sensations of acceleration produced by the circuit are real. But it is doubtless rather the subjective impressions which make these attractions successful, i.e. the feeling of dizziness, of fear or of apprehension, the impression of speed or the illusion of risk. Traditional roller coasters, i.e. travelling on rails, enable spectacular figures, such as loops and other spirals, to mention just these, to be integrated into the ride.

In parallel with the traditional versions, there also exist suspended roller coasters, i.e. travelling beneath a rail, with the passengers being housed in vehicles suspended from the rails, the suspension of the vehicles being designed in a pendular manner, so as to enable the vehicles to tilt laterally in the curves by pivoting around an axis parallel to the axis of the rails. In this case, the balancing of the vehicles with respect to the rails prohibits, for reasons of safety, the most spectacular figures, such as loops or spirals. The circuit therefore by necessity has a more reasonable layout than is the case for traditional roller coasters. As a result the range of sensations offered to the passengers is reduced accordingly.

Regardless of whether the roller coasters are of the traditional type or of the suspended type, the streamlining of the truck in the first case and of the suspended vehicle in the second case produces a relative feeling of safety, which, in fact, reduces the intensity of the subjective sensations which the passengers can experience.

The object of the present invention is to propose a fairground ride of the roller coaster type offering not only all the possibilities of figures for traditional roller coasters, as well as all the objective and subjective sensations which it produces, but also a certain number of unprecedented sensations, accompanied by a much stronger intensity of the sensations already known.

For this purpose the invention relates to an amusement ride of the roller coaster type, comprising at least one seat suspended on a bogie moving along at least one rail, the seat being provided with a device for the restraint of at least one passenger in the seat, the unit being designed so that the passenger is suspended with his legs in mid-air without a wall or a floor around him.

The following description, given by way of example, refers to the drawings in which.

Figure 1:
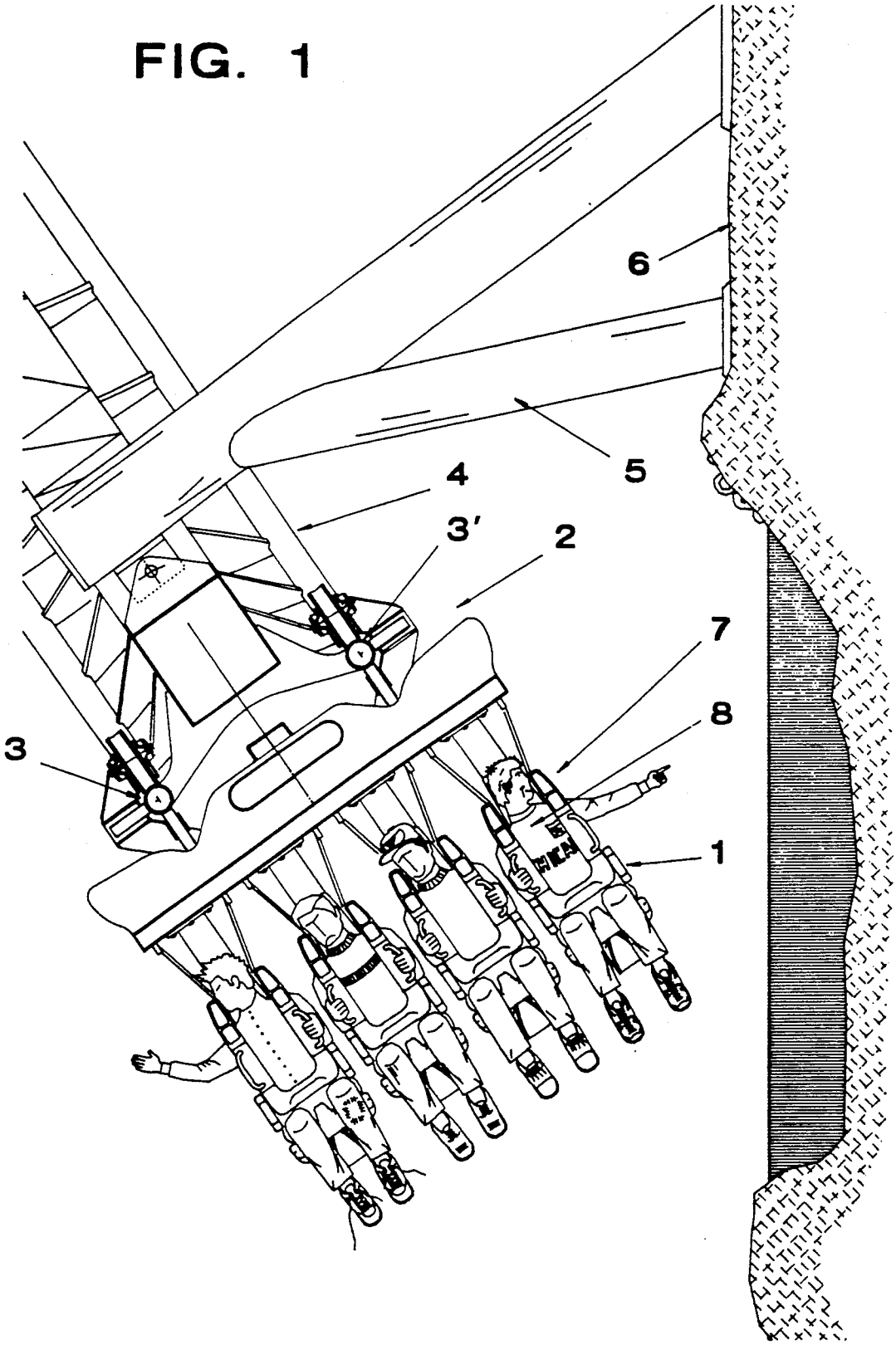
FIG. 1 is a vertical section seen from the front of a ride according to the invention, showing a group of passengers passing above a surface of water.
Figure 2:
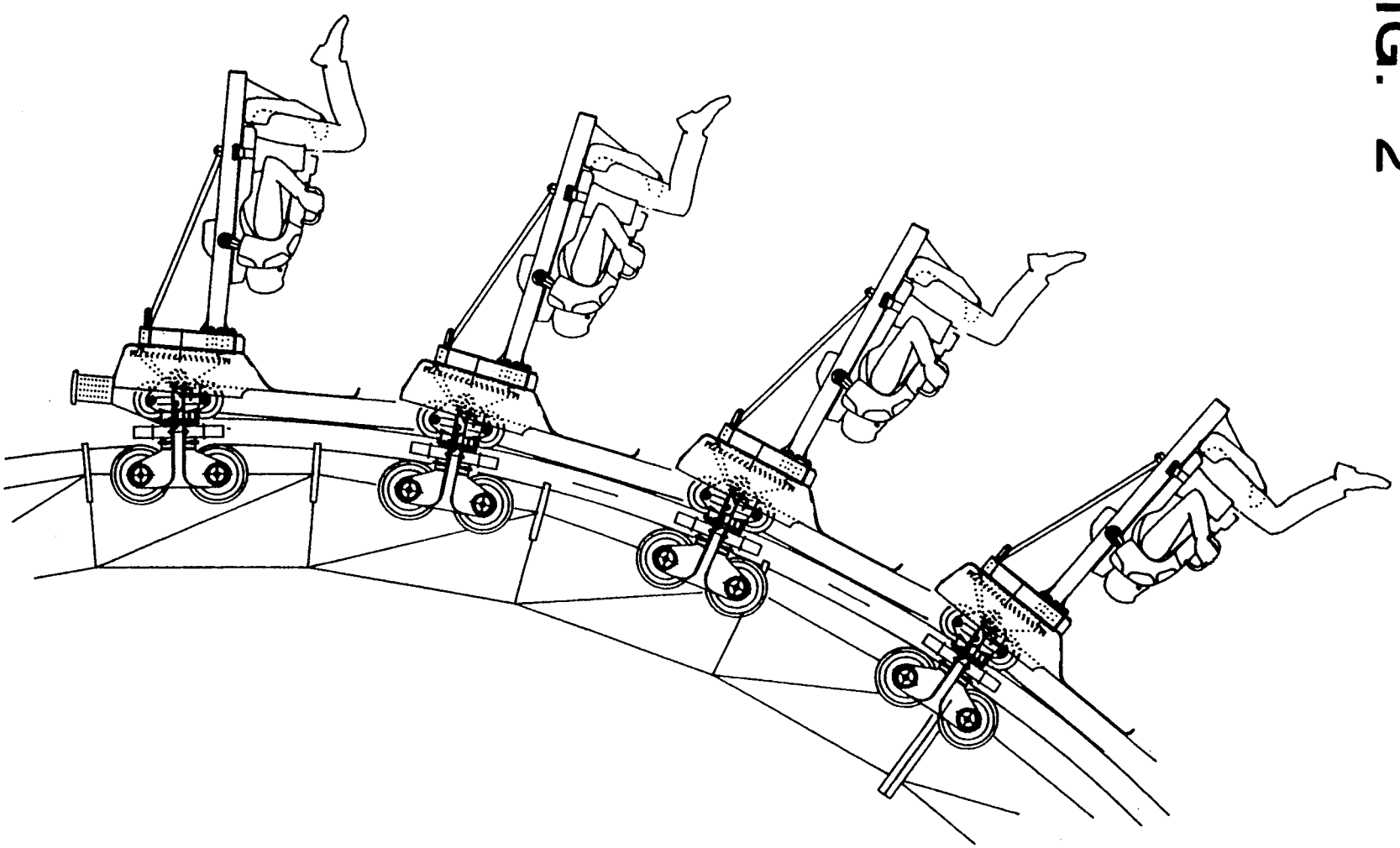
FIG. 2 is a lateral view of another portion of the ride of FIG. 1, showing passengers in a vertical loop.

The fairground ride of the invention enables all the possibilities of figures for traditional roller coasters to be performed, and in particular the most spectacular figures such as vertical or inclined loops and spirals. Two portions of such a ride are shown by way of example on the drawings. The first is shown in FIG. 1. It shows a portion of the ride at the low point of a curve in space, which skims the passengers over the surface of water, by giving them the impression of diving into the water. In the second portion of the ride, shown in FIG. 2, the passengers are positioned head downwards, in the upper part of a loop.

The passengers are seated in seats 1 suspended rigidly from a bogie 2 moving along two rails 3, 3'. As can be seen on FIG. 1, the rails are integral with a structure 4, itself fixed on the ground 6 by means of columns 5. In the case of FIG. 1, the structure is cantilevered on the column 5. Of course this is just an example, any other adequate design of the structure can be envisaged, depending on the figure to be performed.

Each of the passengers is held in his seat by means of a harness 7 so that his body 8 is immobilised between the seat and the harness, but so that each of his four limbs is free. Therefore the passenger is suspended in mid-air, without any wall or floor obstructing his view. He therefore enjoys a great feeling of freedom, from which can result unprecedented sensations, which are subjectively much stronger, because of the impression of freedom, than the sensations which can be experienced on traditional roller coasters.

Figure 3:
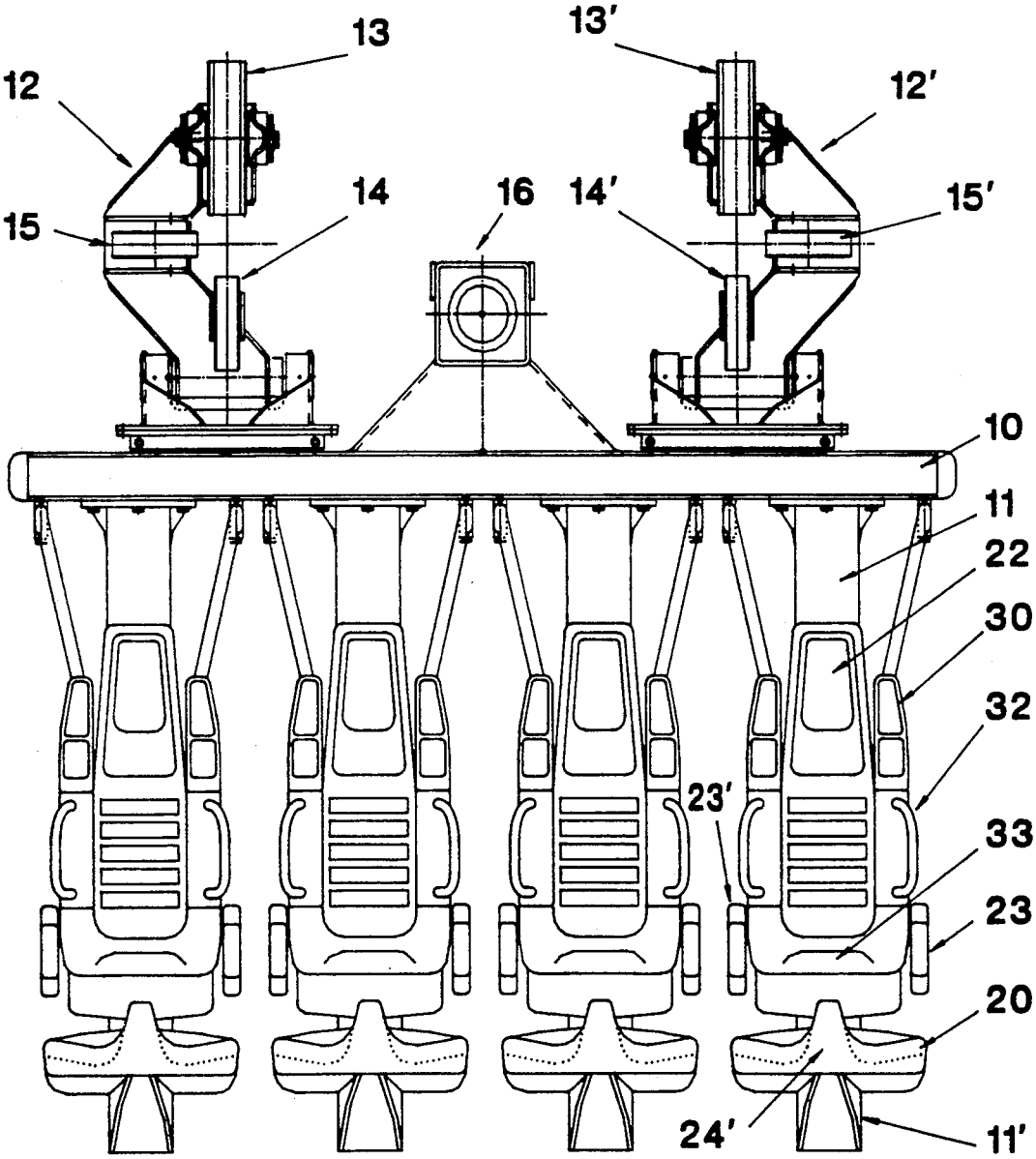
FIG. 3 is a front view of an example of a bogie supporting four seats.
Figure 4:
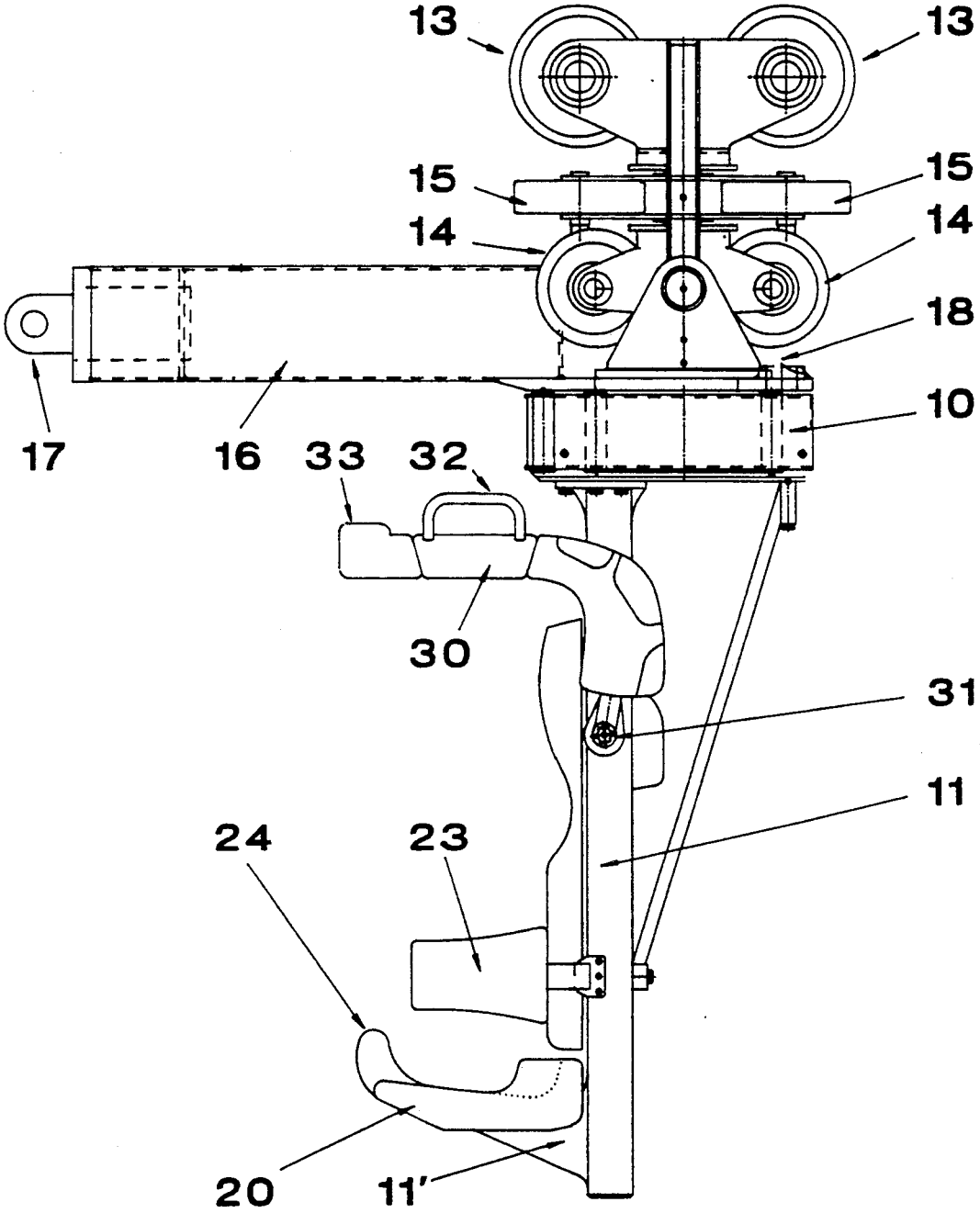
FIG. 4 is a lateral view of the bogie of FIG. 3.

The bogie can comprise one or several seats. One example of a bogie supporting four seats is shown on FIGS. 3 and 4. This bogie comprises a chassis 10 on which are rigidly fixed the support columns 11 for the seats, and on which are mounted two groups 12, 12' of wheels intended to cooperate with each of the two rails 3, 3' of the ride. Each of the groups of wheels comprises three pairs of wheels, i.e. a pair of upper wheels 13, 13' travelling on a rail, a pair of horizontal wheels 15, 15', resting laterally on the outer part of the rail, and a pair of vertical wheels 14, 14' being supported beneath the rail. All the components which have just been described therefore constitute a rigid unit which is supported on the rails, and the movement of which consequently faithfully follows the curves governed by the configuration of the ride. As a result the configuration of the ride is not restricted as in the case of the suspended roller coasters which have hitherto been produced, but it in particular allows figures to be performed in which the passengers have their head downward at a given moment.

The bogie may also comprise a longitudinal girder 16 fixed on to the chassis 10 and protruding forwards above the passenger's seat. This girder 16 comprises at its front end a coupling member 17 intended to cooperate with a complementary coupling member 18 disposed at the rear of the longitudinal girder of another bogie.

As the passengers are suspended in mid-air, it is necessary that they are restrained in a very efficient manner in their seats, and that in no case they can slide from the seat. For this purpose, the seats can for example comprise four parts: a base part 20 constituting the seat in the proper sense of the word, moulded 21, 21' to the shape of the buttocks and the thighs of a passenger, a second part 22 for the dorsal support of the passenger and third and fourth parts 23, 23' disposed laterally and intended for the lateral restraint of the passenger at hip-level. The lateral parts 23, 23' also serve as armrests. The seat may be made from two separate components, i.e. a component constituting the base part 20 and a component constituting the dorsal part 22 and the lateral parts 23, 23'. These components are fixed onto an L-shaped support component formed by the support column 11 and a lower bracket 11' fixed to the lower end of the column 11.

The harness 30 may be a harness of the type with forward tilting, hinged at its upper part 31 on the support column 11 of the seat, the articulation being disposed at shoulder-level of a passenger of average height. In the position of rest, the harness is raised so that the passenger can sit down in the seat. The harness is fitted with two handles 32, 32', which enable the passenger, when he is seated in the seat, to tilt the harness by pulling it backwards towards him. The harness locking device comprises a pawl case acting on a cog wheel, the mechanism enabling the position of the harness to be adjusted according to the height and in particular according to the girth of the passenger. Such a device is known per se and is therefore not described in detail here.

So as to prevent the passenger sliding out of his seat, the shape of the seat is designed so as to form with the harness, when the latter is in the closed position, a restraint around the passenger's body, this restraint comprising four separate openings for the passage of the passenger's limbs. For this purpose, the dimensions of the harness are chosen so that its lower part 33 is disposed at the level of the lateral restraint parts 23, 23' of the seat and so that its width roughly corresponds to the distance separating the two lateral parts 23, 23'. On the other hand the base part 20 of the seat comprises a projecting median part 24 which protrudes upwards at the front of the seat, so that when the harness is in the closed position, its lower part 33 is situated roughly at the level of the projecting part 24 of the seat, so as to prevent the passenger sliding forwards.

Figure 5:
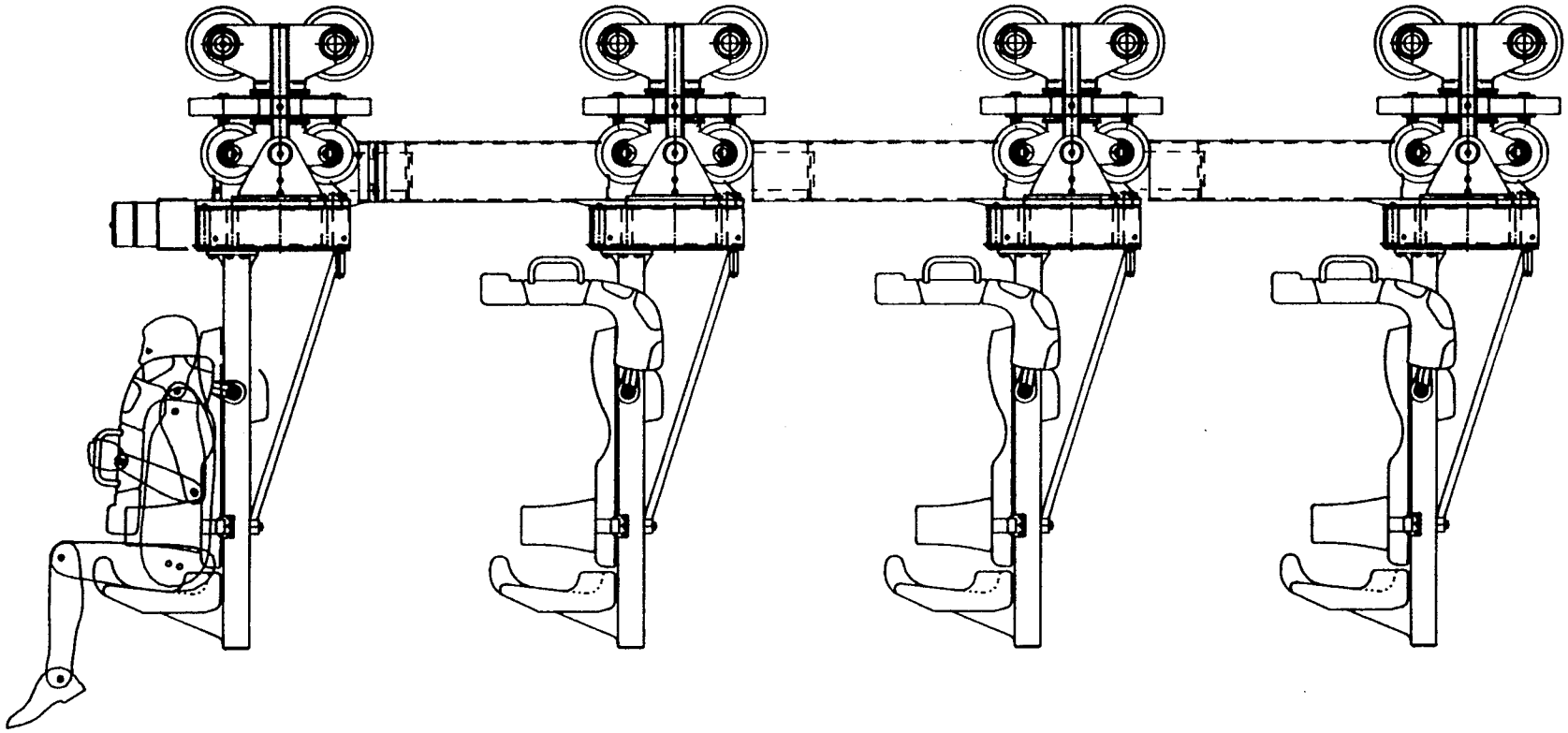
FIG. 5 is a partial lateral view of a train comprising a plurality of interconnected bogies.

A train of several bogies is shown in FIG. 5. It may be noted that the first bogie of the train comprises a longitudinal girder 16 which is clearly shortened. In fact, the whole cantilevered part of this girder serves no purpose for the first bogie.

According to a variant embodiment, the suspending of the seat can be provided in a pendular manner, the other design features of the seat being the same as described hereabove.

The advantages of the fairground ride according to the invention lie in a great increase in the intensity of the sensations already offered by traditional roller coasters, but also in the possibility of offering new sensations which are even more impressive.

The layout of a ride generally begins with a gradient which enables the vehicles to gain the height necessary for completing the circuit. The first figure following this gradient is also generally a nose dive which benefits from the maximum height achieved. In a traditional roller coaster, this first nose dive gives rise to a strong acceleration at the beginning, then to a falling feeling which the passengers often amplify by raising their arms. The end of the nose dive is marked by a strong compression. All these sensations are encountered in the comparable figure of the ride according to the invention, but in addition there is the illusion of crashing to the ground, as the passengers have nothing beneath them. There is also an impression of the unknown which results from the fact that the passengers can not see the rest of the ride layout, as is the case with traditional roller coasters. The intensity of all the feelings is therefore much stronger, with the difference doubtless being greater than if a same circuit is performed, at the same speed, first in a convertible car and then on a bicycle.

In fact, as he is only integral with his seat by the restraint of his trunk, the passenger has an increased feeling of freedom, but also of risk. The passenger also has the impression that it is he himself who performs the figure, independently, which creates an impression of flight at high speed, which has hitherto been totally unknown.

Depending on the environment of the circuit, other new sensations may be mentioned, such as that of a last minute escape from a dive into water; hedge-hopping and, in general, only just avoiding all sorts of obstacles. Finally, in figures such as loops and spirals, since the passengers are suspended under the rails, and therefore at the exterior of the curve, they have the impression of taking flight

We claim:

1. A roller coaster amusement ride, comprising:

a pair of parallel, roller coaster rails fixed in space;

a bogie freely moveable along said rails;

means to seat a passenger rigidly affixed to said bogie so as to avoid any pendulum-like movement, and that position a seated passenger's head in closer proximity to said bogie than are the passenger's body and limbs, and that position a seated passenger's limbs to suspend freely; and means to harness a seated passenger to said means to seat a passenger that immobilize a seated passenger's body, but permit a seated passenger's limbs to remain freely suspended.

2. A passenger apparatus for a roller coaster amusement ride, comprising:

a bogie that is freely moveable along a roller coaster track fixed in space;

means to seat a passenger rigidly affixed to said bogie so as to avoid any pendulum-like movement, and that position a seated passenger's head in closer proximity to said bogie than are the passenger's body and limbs, said that position a seated passenger's limbs to suspend freely; and means to harness a seated passenger to said means to seat a passenger that immobilize a seated passenger's body, but permit a seated passenger's limbs to remain freely suspended.

3. A roller coaster amusement ride, comprising:

a roller coaster track fixed in space;

a bogie freely moveable along said track;

means to seat a passenger rigidly affixed to said bogie so as to avoid any pendulum-like movement, and that position a seated passenger's head in closer proximity to said bogie than are the passenger's body and limbs, and that position a seated passenger's limbs to suspend freely; and means to harness a seated passenger to said means to seat a passenger that immobilize a seated passenger's body, but permit a seated passenger's limbs to remain freely suspended.

* * * * *